US005087035A

United States Patent [19]

Podd, III

[11] Patent Number: 5,087,035

[45] Date of Patent: Feb. 11, 1992

[54] RECREATIONAL APPARATUS FOR PROPELLING A PERSON ABOUT A FIXED POINT

[76] Inventor: George O. Podd, III, 24 W. 270 Plamondon Dr., Wheaton, Ill. 61087

[21] Appl. No.: 383,932

[22] Filed: Jul. 21, 1989

[51] Int. Cl.[5] ..... A63B 1/00

[52] U.S. Cl. ..... 272/93; 273/453; 119/29

[58] Field of Search ..... 272/70 A, 93, 128, DIG. 9, 272/33, 33 R; 119/29; 273/98, 1, 95 R, 1 R

[56] References Cited

U.S. PATENT DOCUMENTS 895,055 8/1908 Spooner .
3,563,208 2/1971 Nero .
3,747,929 7/1973 Burke .
3,752,474 8/1973 Macabet et al. .
3,810,613 5/1975 Jorwa .
4,245,839 1/1981 Trent ..... 272/DIG. 9
4,256,098 3/1981 Swan et al. .
4,748,937 6/1988 Musetti .
4,772,014 9/1988 Rebman ..... 272/93

*Primary Examiner*—Stephen R. Crow
*Attorney, Agent, or Firm*—Speckman & Pauley

[57] ABSTRACT

A recreational apparatus for propelling a person about a fixed point. A base is fixed with respect to ground. An extendable link is pivotally attached to the base. A handle is attached to the opposite end of the extendable link. The extendable link extends from an equilibrium position to an extended length upon application of an outward force applied to the extendable link. The outward force has an outward force component directed outward from the base along a longitudinal axis of the extendable link. After release of the outward force, the extendable link returns to its equilibrium position with an inward force. The inward force has an inward force component equal in magnitude and opposite in direction to the outward force component.

10 Claims, 5 Drawing Sheets 41
57
55
56
30

60
41
57
56
30

66
41
30
65
50

71
52
41
30
70
30

75
41
76
30

81

41
80
30

41
52
50
51
30

40
85
86
87
88
89
90

40
42
45
46
47
48
49

RECREATIONAL APPARATUS FOR PROPELLING A PERSON ABOUT A FIXED POINT

BACKGROUND OF THE INVENTION

1. Field of the Invention

A recreational apparatus for propelling a person about a fixed point wherein the apparatus includes a base fixed with respect to ground, an elastic link pivotally attached to the base, and a handle secured to a free end of the elastic link.

2. Description of the Prior Art

Swan et al., U.S. Pat. No. 4,256,098, discloses a safety restraint system for ambulatory patients. The restraint mechanism includes a flexible tether or cord attached at one end to a harness or garment worn by a patient. An opposite end of the flexible tether o cord is attached to an inertial reel. The reel is mounted in a track or groove formed in a ceiling of a room or is mounted to an overhead frame. A spring in the reel normally tends to retract the tether to maintain slight tension when it is attached to the patient's harness. If the patient suddenly falls, a centrifugally or hydraulically operated safety mechanism in the reel immediately resists rotation of the reel in an unwinding direction, thereby causing the patient to be lowered gently to the floor. The '908 patent teaches no means for retracting the tether or cord once it is extended from the reel. Thus, a patient that falls to the ground would not use the same mechanism to be lifted from the ground.

Musetti, U.S. Pat. No. 4,748,937, teaches a retractable leash which coils up automatically when no outward force is applied to the handle. Such device is intended to be fixedly attached to the collar of an animal or to the front of a skateboard or surfboard. The leash is made of a high strength cable with means for attachment at one end to an animal collar or to a surfboard or skateboard and means for attachment to a handle assembly at the other end of the cable.

Spooner, U.S. Pat. No. 895,055, teaches an apparatus for supporting roller skaters in a rink. A chain link is attached at one end to a spiral spring. The spiral spring is mounted within a housing which is moveable with respect to a floor of a rink by a trackway mounted from an overhead structure.

Jorwa, U.S. Pat. No. 3,810,613, discloses an exercise and weight reduction device having two elliptical channels which have congruent major axes. The elliptical channels are used as tracks. A user of the device places its feet on skates and while grasping hand grips connected to upright support members, moves its feet in the elliptical paths defined by the tracks.

Rebman, U.S. Pat. No. 4,772,014, discloses a physical rehabilitation platform which is used to train a patient to properly walk or run, following an injury. A patient steps or bounces at various angles on panels of a platform while being tethered by an elastic cord.

Macabet, et al., U.S. Pat. No. 3,752,474, discloses a portable exercise apparatus having hand grips attached to opposite ends of a cable for reciprocation during exercise. The hand grips are mounted on a separate cable which is threaded through a pulley.

Trent, U.S. Pat. No. 4,245,839, discloses an exercise device for running in place. The device includes a belt and a single piece of rope. One end of the rope is secured to a fixed object while the other end of the rope is formed into an adjustable belt by a loop forming device.

Burke, U.S. Pat. No. 3,747,929, discloses an apparatus for playing a game. The game apparatus includes hip pads attached to a cord to form a waistband. A swinging striker is attached to a swivel plate which is attached to each player's cord. The striker is used to knock down different colored playing pieces.

Nero, U.S. Pat. No. 3,563,208, teaches a device for maintaining walking children in an organized, supervised group. The device includes an elongated center support member, a plurality of laterally extending crossmembers secured along the length of the center support member. Handles for children to grasp are secured to the distal ends of the crossmembers. The crossmembers are preferably constructed of rope having metal wire reinforcement.

SUMMARY OF THE INVENTION

Due to the interest in the recreational use and the sport of skateboarding, applicant has developed the apparatus of this invention to be preferably used with a skateboard. This invention will eliminate many of the dangers exposed to the user or skater when skating freely in the street.

This apparatus will provide for hours of competition and entertainment in a designated area such as a gymnasium, playground or driveway, and thus will allow the ease of adult supervision.

It is one object of this invention to provide an apparatus for enjoyment or exercise in which one or more persons can use a skateboard, roller skates, ice skates and the like to be self-propelled about a fixed point.

It is another object of this invention to provide a recreational apparatus having an elastic member which extends from an equilibrium position to an extended length position and then back to the equilibrium position.

It is yet another object of this invention to provide a recreational apparatus that can be mounted or secured to ground or a suitable structure.

This invention relates to a recreational apparatus used by one or more persons to propel each person about a fixed point. In one embodiment of this invention, the apparatus includes a base that is fixed with respect to ground. At least one extendable link is pivotally attached to the base. Each person grasps a handle which is secured to an opposite end of each corresponding extendable link.

In operation, a person on a skateboard accelerates on the skateboard and upon reaching a certain velocity picks up the handle and moves with the direction thereby extending the extendable link. As the extendable link extends from an equilibrium position to an extended length, the extendable link is exposed to an outward force from the person on the skateboard. The outward force has an outward force component directed outward from the base along a longitudinal axis of the extendable link. Once the person reaches the limit of elasticity of the extendable link, the outward force is diminished to zero and the extendable link returns to the equilibrium position. During the return, the extendable link exerts an inward force which moves the person back toward the base. Upon return of the extendable link means to the equilibrium position, the inward force has an inward force component approximately equal in magnitude to and opposite in direction from the outward force component.

In one preferred embodiment of this invention, the extendable link is pivotally attached to the base by having a shaft secured to the base. A rotor is rotatably mounted on the shaft and a base end of the extendable link is secured to the rotor. In another preferred embodiment, the extendable link is pivotally attached to the base by having the base end of the extendable link secured to an extension member. The extension member is secured to the rotor such that the extension member pivots with respect to the shaft.

In another embodiment, the extendable link is pivotally attached to the base by having a universal joint with a base shaft attached to the base and a link shaft attached to the base end of the extendable link. In another embodiment, the extendable link is pivotally attached to the base by having a ball joint with a base shaft attached to the base. A link shaft of the ball joint is attached to the base end of the extendable link.

In another embodiment according to this invention, the extendable link is pivotally attached to the base by having a shaft secured to the base and a ring positioned over the shaft. The ring is rotatable with respect to the base. The base end of the extendable link is secured to the ring and the ring is retained on the shaft. In another embodiment of this invention, the extendable link is pivotally attached to the base by having a coil spring with one end secured to the base. A disk is attached to the base end of the extendable link at an extension member of the disk. The disk is secured to an opposite end of the coil spring.

In yet another embodiment of this invention, the extendable link is pivotally attached to the base by having a flexible stem with one end secured to the base and an opposite end secured to the base end of the extendable link. Preferably, the flexible stem includes a flexible tube. In still another embodiment according to this invention, the extendable link is pivotally attached to the base by having a chain with one end of the chain secured to the base. An opposite end of the chain is secured to the base end of the extendable link.

In one preferred embodiment of this invention, the extendable link includes at least one elastic hose. It is apparent that the extendable link can include other members capable of stretching to an outer length then returning to an equilibrium position. The extendable link may also include at least one elastic cord, at least one helical spring, and/or at least one telescopic member. It is also apparent that the extendable link can include at least one cable which is retractable within a cable recoiler.

The person grasps a handle which may include a bracket secured to a grasping end of the extendable link. An elongated rod is secured to the bracket. In another embodiment of this invention, at least one wristband can be used in lieu of the handle. Each wristband is secured to the grasping end of the extendable link. In another embodiment, the wristband can be replaced with a waistband.

In yet another embodiment according to this invention, a plurality of extendable links are pivotally connected to the base by having a shaft secured to the base. A plurality of rotors are rotatably mounted on the shaft. Each extendable link has a base end secured to a corresponding rotor. Such arrangement allows two or more persons to use the same base of the apparatus.

BRIEF DESCRIPTION OF THE DRAWINGS

The above mentioned and other features of this invention and the manner of obtaining them will become more apparent, and the invention itself will be best understood by reference to the following description of specific embodiments of this invention taken in conjunction with the accompanying drawings, in which.

DESCRIPTION OF PREFERRED EMBODIMENTS

Figure 1:
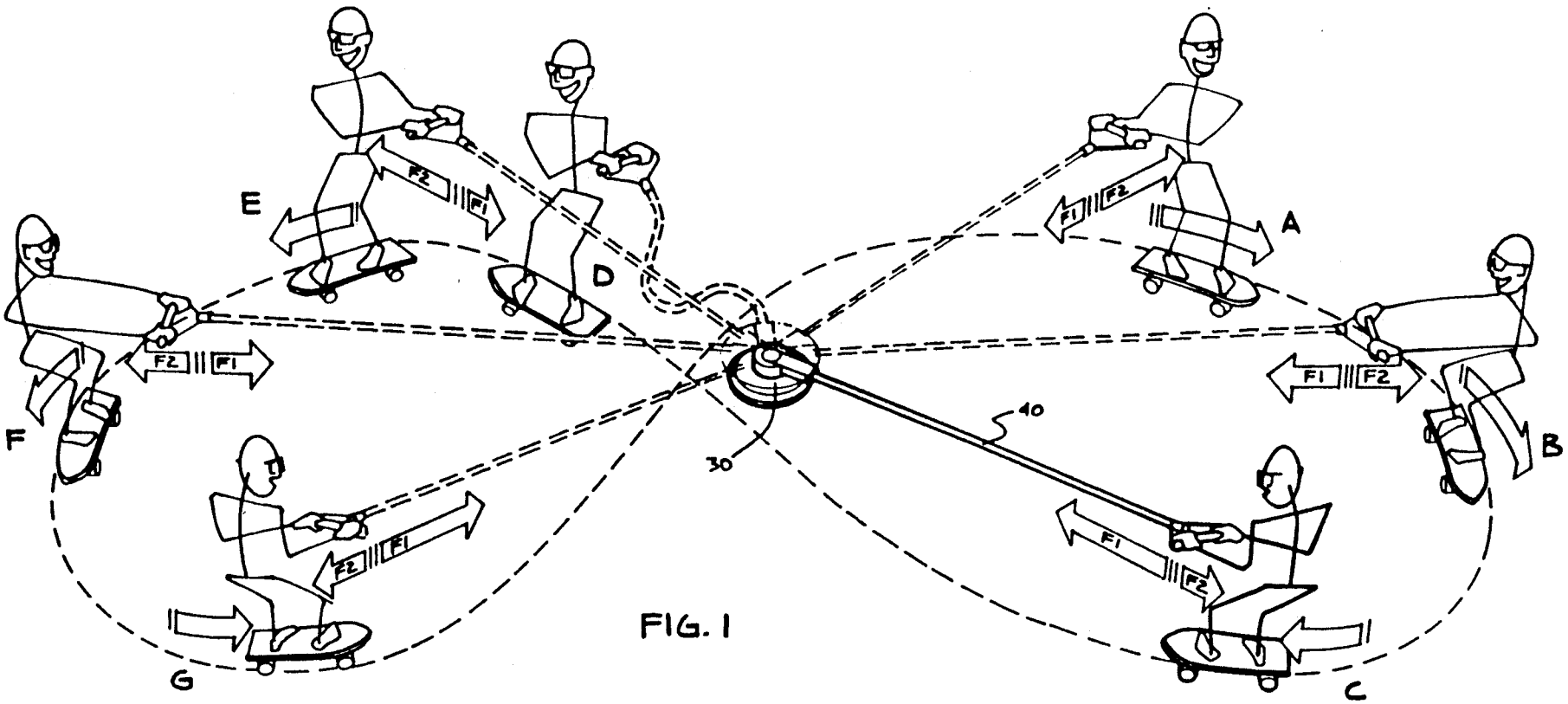
FIG. 1 is a perspective view showing one person in seven different positions throughout a Figure-8 path about the base.

FIG. 1 shows a perspective view of one person using the recreational apparatus of this invention. As shown in FIG. 1, the person is traversing about base 30 in a Figure-8 path. At positions A–G, the arrows along the longitudinal axis of extendable link 40 show F1 and F2 which denote the inward and outward forces, respectively, within extendable link 40. At position A, the person moves outward, away from base 30 and thus F2 is greater than F1. At position B, the person decelerates in the outward direction until F1 is equal to F2 and then begins to move inward. At position C, the person is moving inward and F1 is greater than F2 and thus the person begins to accelerate. At position D, the person has reached maximum velocity and begins to decelerate. At position E, the person is moving outward and thus F2 is greater than F1; position E corresponds to position A. Position F corresponds to position B and position G corresponds to position A.

FIG. 1 shows one embodiment of a path which can be used with the apparatus of this invention. It is also apparent that the apparatus of this invention can be used to create a variety of other paths, such as an oval, a loop, and the like.

Figures 2, 3:
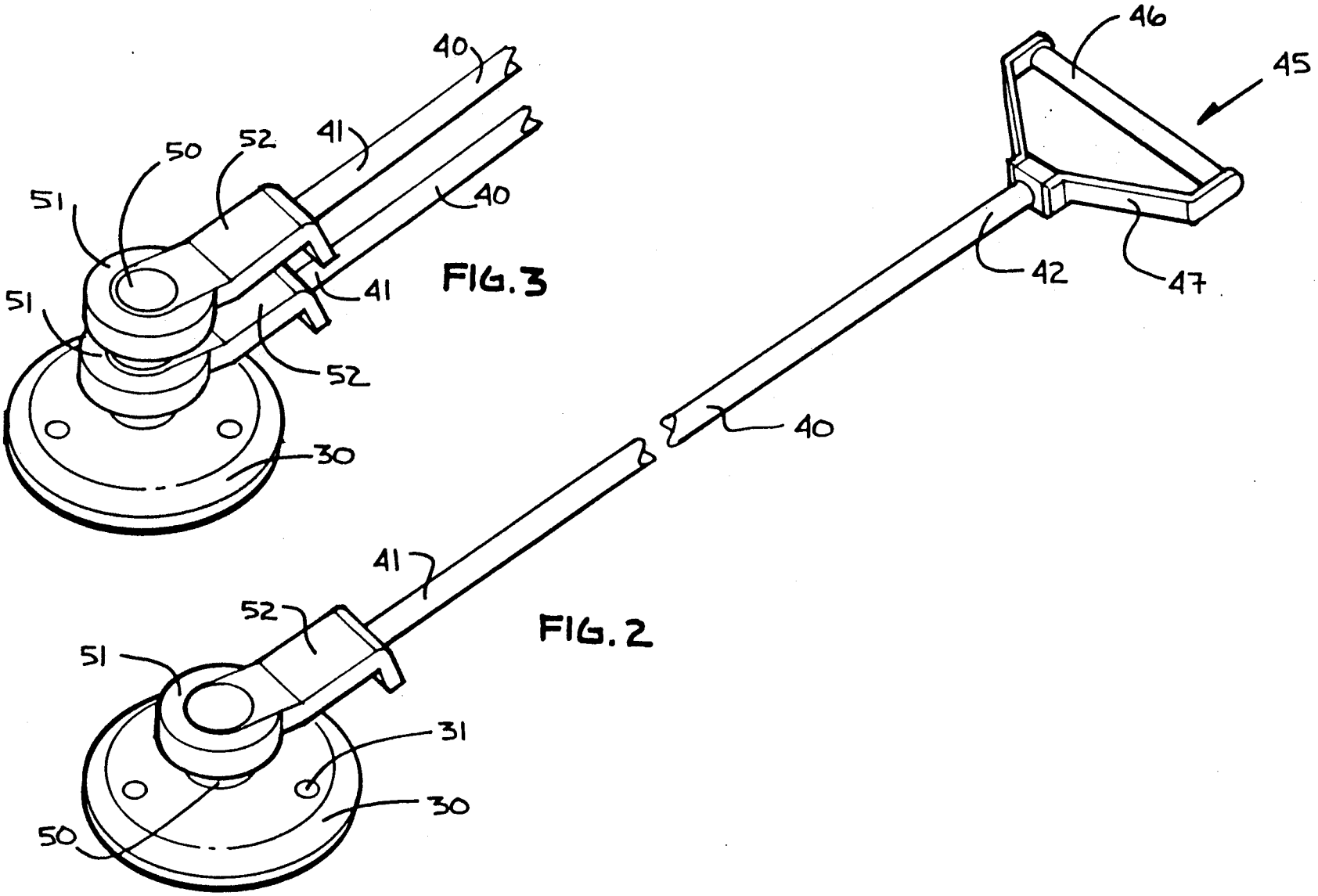
FIG. 2 is a perspective view of the recreational apparatus according to one embodiment of this invention.
FIG. 3 is a perspective view of the base and a plurality of extendable links according to another embodiment of this invention.

In a preferred embodiment according to this invention as shown in FIG. 2, the apparatus includes base 30 which is fixed with respect to ground. Throughout this application the term "ground" means any stable structure to which base 30 can be attached. For example, ground may include a driveway, a platform, a stage, a pier in the water, a ceiling, a wall and the like. This invention can be used in a wide variety of environments.

This invention can also be used with various ramps to create a type of course. This invention can be used with skateboards as well as snow boards, surfboards, Boogie boards, skim boards, snow skis, roller skates, roller blades, ice skates and the like.

Base 30 can be fixed with respect to ground by securing base 30 with bolts, anchors, spikes and the like through mounting hole 31. In other preferred embodiments, base 30 is secured with adhesives, bonding methods, magnets, C-clamps and the like; such methods do not necessarily require mounting hole 31. It is also apparent that base 30 can have internal or external threads for screwing into a fitting or base 30 can be secured with respect to ground in any other suitable method known in the art.

Extendable link means are pivotally attached to base 30. Grasping means for the person to grasp extendable link 40 are secured to an opposite end, grasping end 42, of extendable link 40. The extendable link means extend from an equilibrium position, as shown at position D in FIG. 1, to an extended length, as shown at positions A–C and E–G upon application of an outward force to the extendable link means exerted by momentum of the moving person. The outward force has an outward force component directed outward from base 30 along a longitudinal axis of the extendable link means. Once the outward force is released, at the time the person reaches maximum velocity, the extendable link means returns to its equilibrium position with an inward force. Upon return of the extendable link means to the equilibrium position, the inward force has an inward force component approximately equal in magnitude and opposite in direction to the outward force component. Throughout this specification and in the claims of this invention, the inward force is said to have an inward force component approximately equal in magnitude and opposite in direction to the outward force component. Such language is intended to account for the fact that the outward force changes over a certain period of time and so does the inward force change over a certain period of time. By referring to the outward and inward forces in such manner, applicant intends to include rate of change of the forces.

The extendable link means may include a variety of extendable links 40 as shown in FIGS. 11–14. The extendable link means may comprise elastic cord 85, elastic hose 86, helical spring 87 and/or telescopic member 88. In another embodiment of this invention, the extendable link means includes cable 89 which is wound around cable recoiler 90 which is spring loaded, as shown in FIG. 15. Cable 89 and cable recoiler 90 will cause extendable link 40 to function similar to those embodiments shown in FIGS. 11–14. It is apparent that the extendable link means may include at least one, possibly two or more, extendable links 40. It is also apparent that any combination of extendable links 40, as shown in FIGS. 11–14, can be used. Cable recoiler 90, as shown in FIG. 15, has a base which is preferably attached to a rotational device for providing full pivotal movement in 3 directions.

Figures 4, 5, 6, 7, 8, 9, 10, 10A:
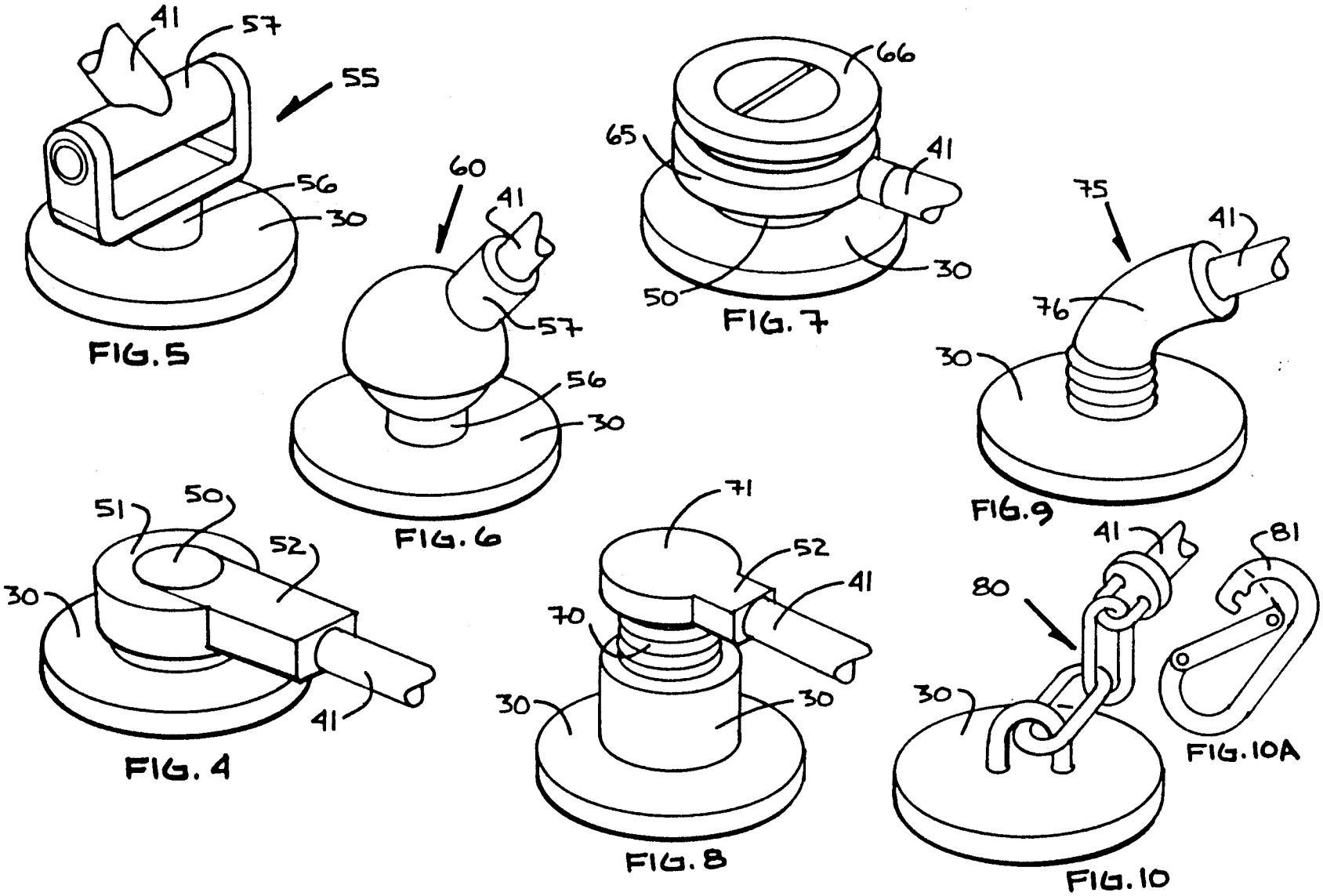
FIGS. 4–10 are perspective views of different embodiments of the pivotal connection between the base and the link.
FIG. 10A shows a carabiner which is used to attach the chain shown in FIG. 10.
Figures 11, 12, 13, 14, 15:
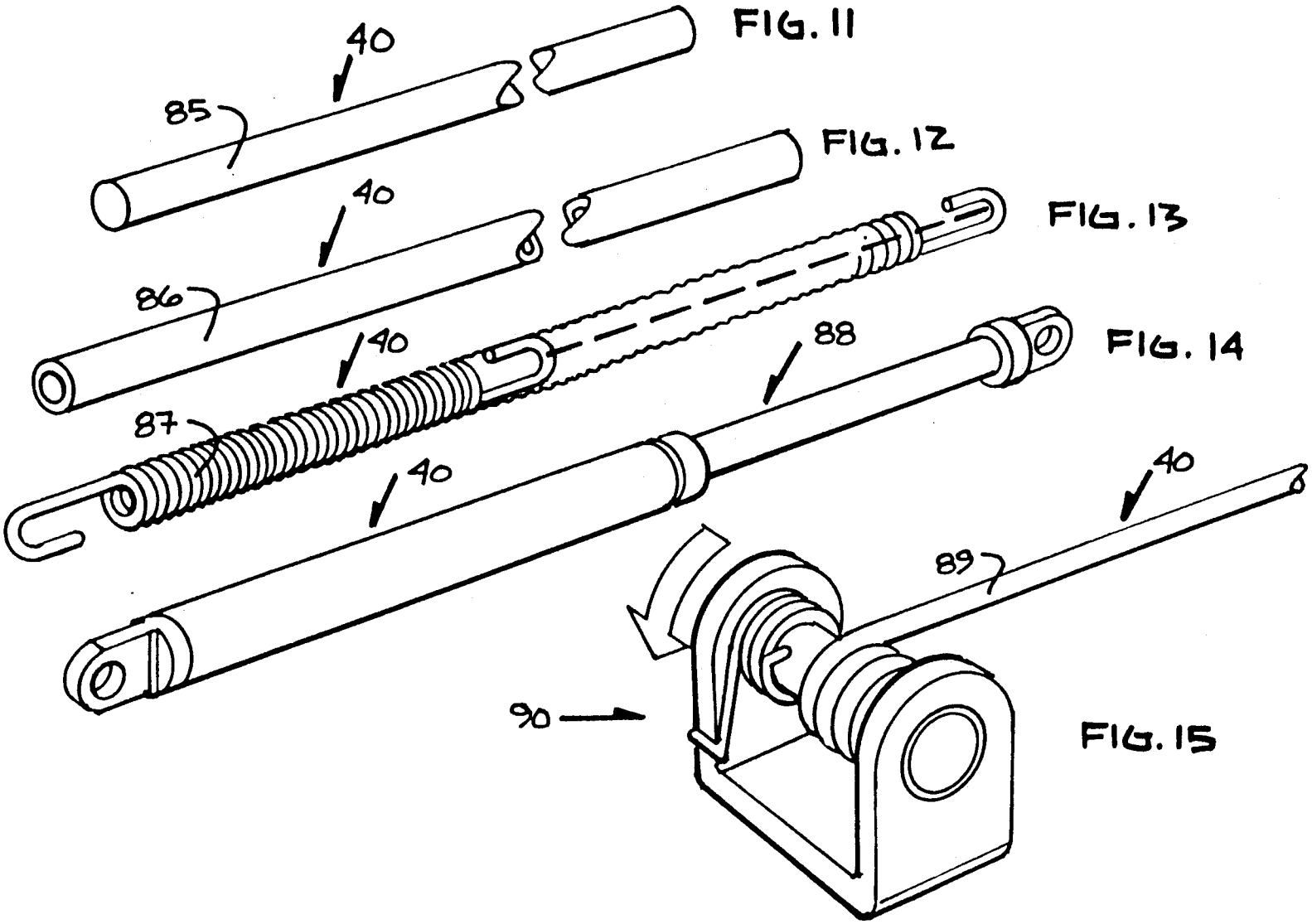
FIGS. 11–15 are perspective views of different embodiments of the extendable link of this invention.

The pivotal connection means is used to pivotally attach extendable link 40 to the base. Several different preferred embodiments of the pivotal connection means are shown in FIGS. 4–10. FIG. 4 shows the pivotal connection means having shaft 50 secured to base 30 in any suitable manner known in the art. Rotor 51 is rotatably mounted on shaft 50. Base end 41 of extendable link 40 is secured to extension member 52 of rotor 51. It is apparent that in each embodiment of the pivotal connection means, extendable link 40 can be either fixedly secured, pivotally attached, or rotatably attached with respect to the pivotal connection means.

FIG. 5 shows another embodiment of the pivotal connection means where universal joint 55 has base shaft 56 secured to base 30. Link shaft 57 is attached to base end 41 of extendable link 40. FIG. 6 shows another embodiment in which the pivotal connection means includes ball joint 60. Base shaft 56 of ball joint 60 is secured to base 30. Link shaft 57 of ball joint 60 is attached to base end 41 of extendable link 40.

FIG. 7 shows another embodiment of the pivotal connection means in which shaft 50 is secured to base 30. Ring 65 is positioned over shaft 50 and ring 65 is rotatable with respect to base 30. Base end 41 of extendable link 40 is attached to ring 65. Ring 65 is retained on shaft 50 by ring retaining means which in one preferred embodiment includes cap 66 threadedly secured to shaft 50. It is apparent that cap 66 can be replaced by any other retaining means familiar to the art.

FIG. 8 shows a preferred embodiment of the pivotal connection means in which extendable link 40 is attached at base end 41 to extension member 52 of top 71. Top 71 is secured to one end of coil spring 70. The opposite end of coil spring 70 is secured to base 30. Such embodiment provides pivotal movement of extendable link 40 with respect to base 30. It is apparent that coil spring 70 can be replaced with a threaded shaft which mates with a threaded coupling of base 30. It is also apparent that coil spring 70 can be replaced with a threaded coupling which mates with a threaded shaft attached to base 30. Such threaded connection provides rotational movement of extendable link 40, with respect to base 30. Extendable link 40 provides additional freedom to make the movement pivotal. Throughout this application, the term "pivotal connection means" is intended to include rotational movement as well as vertical displacement of extendable link 40 with respect to base 30.

FIG. 9 shows another embodiment of the pivotal connection means in which flexible stem means have one end secured to base 30 and an opposite end attached to base end 41 of extendable link 40. The flexible stem means can include a flexible tube, a flexible rod, a flexible knob or any other suitable flexible stem known in the art. It is apparent that the flexible stem is not limited to a tubular shape but can be any other suitably shaped stem that provides the desired flexibility.

FIG. 10 shows yet another embodiment of the pivotal connection means having one end of chain 80 secured to base 30 and an opposite end of chain 80 attached to base end 41 of extendable link 40. FIG. 10A shows carabiner 81 which can be used to quickly connect and disconnect chain 80 from either base 30 or base end 41 of extendable link 40.

Figures 16, 17, 18, 19, 20, 21:
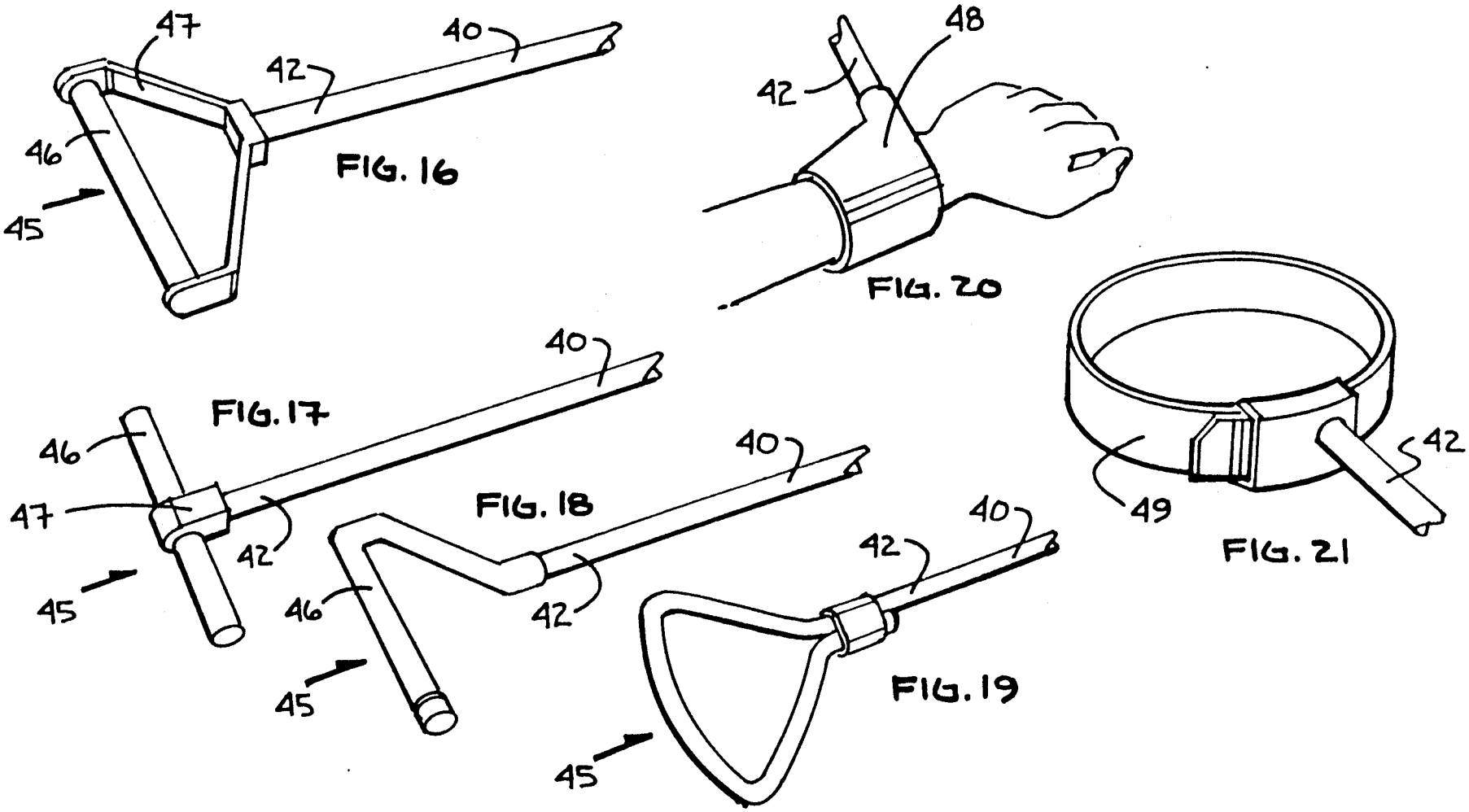
FIGS. 16–19 are perspective views of different embodiments of handles according to this invention.
FIG. 20 is a perspective view of a wristband according to one embodiment of this invention.
FIG. 21 is a perspective view of a waistband according to one embodiment of this invention.

The grasping means of this invention are used by the person for holding onto extendable link 40. Different preferred embodiments of the grasping means are shown in FIGS. 16–21. FIG. 16 shows handle 45 comprising bracket 47 which is attached to grasping end 42 of extendable link 40. Rod 46 is secured between two ends of bracket 47. FIG. 17 shows another embodiment of the grasping means in which handle 45 comprises a T-handle with bracket 47 attached to grasping end 42 of extendable link 40. FIG. 18 shows another preferred embodiment of a handle, similar to the embodiment shown in FIG. 17. FIG. 19 shows extendable link 40 looped at grasping end 42 to form handle 45.

FIG. 20 shows another preferred embodiment of the grasping means in which wristband 48 is attached to grasping end 42 of extendable link 40. FIG. 21 shows yet another preferred embodiment of the grasping means in which waistband 49 is attached to grasping end 42.

It is apparent that multiple persons can use the apparatus according to this invention. FIG. 3 shows the recreational apparatus set-up for two users. FIG. 3 shows one base 30, one shaft 50, two rotors 51, and two extendable links 40. Each extendable link 40 is attached to a corresponding extension member 52 at base end 41. It is apparent that extendable link 40 can include an elastic link such as elastic cord 85 and/or elastic hose 86, or any other extendable link 40 as described above.

While in the foregoing specification this invention has been described in relation to certain preferred embodiments thereof, and many details have been set forth for purpose of illustration it will be apparent to those skilled in the art that the invention is susceptible to additional embodiments and that certain of the details described herein can be varied considerably without departing from the basic principles of the invention.

I claim:

1. A recreational apparatus for propelling a person about a fixed point, the apparatus comprising:

a base fixed with respect to ground;

extendable link means having pivotal connection means at a base end of said extendable link means for pivotally attaching said base end to said base, said pivotal connection means further comprising a shaft secured to said base, a ring positioned over said shaft, said ring rotatable with respect to said base, said base end attached to said ring, and ring retaining means for retaining said ring on said shaft;

grasping means secured to a grasping end of said extendable link means, said grasping end opposite said base end; and said extendable link means extending from an equilibrium position to an extended length upon application of an outward force to said extendable link means, said outward force having an outward force component directed outward from said base and along a longitudinal axis of said extendable link means, after release of said outward force said extendable link means returning to said equilibrium position with an inward force, and upon return of said extendable link means to said equilibrium position said inward force having an inward force component approximately equal in magnitude and approximately opposite in direction to said outward force component.

2. An apparatus according to claim 1 wherein said extendable link means further comprise at least one elastic cord.

3. An apparatus according to claim 1 wherein said extendable link means further comprise at least one elastic hose.

4. An apparatus according to claim 1 wherein said extendable link means further comprise at least one helical spring.

5. An apparatus according to claim 1 wherein said extendable link means further comprise at least one telescopic member.

6. An apparatus according to claim 1 wherein said extendable link means further comprise at least one cable and each said cable is retractable within cable recoiling means.

7. An apparatus according to claim 1 wherein said grasping means further comprise handle means.

8. An apparatus according to claim 7 wherein said handle means further comprise a bracket secured to said grasping end of said extendable link means and an elongated rod secured to said bracket.

9. An apparatus according to claim 1 wherein said grasping means further comprise at least one wristband secured to said grasping end of said extendable link means.

10. An apparatus according to claim 1 wherein said grasping means further comprise a waistband secured to said grasping end of said extendable link means.

* * * * *